US012600544B2

(12) United States Patent
Harris et al.

(10) Patent No.: US 12,600,544 B2
(45) Date of Patent: Apr. 14, 2026

(54) COATED MEMBRANES AND METHODS OF MAKING THE SAME

(71) Applicant: Georgia Tech Research Corporation, Atlanta, GA (US)

(72) Inventors: Tequila A. Harris, Atlanta, GA (US); Tae Joong Jeong, Atlanta, GA (US); Yue Ji, Atlanta, GA (US); Kwangjun Jung, Atlanta, GA (US); James Carson Meredith, Atlanta, GA (US)

(73) Assignee: Georgia Tech Research Corporation, Atlanta, GA (US)

( * ) Notice: Subject to any disclaimer, the term of this patent is extended or adjusted under 35 U.S.C. 154(b) by 337 days.

(21) Appl. No.: 18/176,075

(22) Filed: Feb. 28, 2023

(65) Prior Publication Data

US 2023/0257173 A1 Aug. 17, 2023

Related U.S. Application Data

(63) Continuation of application No. 18/048,587, filed on Oct. 21, 2022, now abandoned.

(60) Provisional application No. 63/270,586, filed on Oct. 22, 2021.

(51) Int. Cl.
*B65D 65/42* (2006.01)

(52) U.S. Cl.
CPC ..... *B65D 65/42* (2013.01); *B65D 2565/387* (2013.01)

(58) Field of Classification Search
CPC .... B65D 65/42; B65D 2565/387; B05D 1/26; B05D 1/34; B05D 1/36; B05D 3/062; B05D 3/0254; B05D 3/002; B05D 3/007; B05D 2201/02; B05C 5/0245; B05C 5/0254

See application file for complete search history.

(56) References Cited

U.S. PATENT DOCUMENTS

| | | | | |
|---|---|---|---|---|
| 5,962,075 | A * | 10/1999 | Sartor | B05C 9/06 118/411 |
| 6,565,927 | B1 * | 5/2003 | Drzal | G21K 5/10 427/398.1 |
| 9,662,863 | B2 * | 5/2017 | Lorenzetti | B32B 1/00 |
| 2004/0033379 | A1 * | 2/2004 | Grunlan | B32B 27/30 428/500 |
| 2021/0207326 | A1 * | 7/2021 | Fushimi | B32B 27/18 |

* cited by examiner

*Primary Examiner* — Michael P Wieczorek
(74) *Attorney, Agent, or Firm* — TROUTMAN PEPPER LOCKE LLP; Ryan A. Schneider; Nicholas H. Doss

(57) ABSTRACT

An exemplary embodiment of the present disclosure provides a membrane including a supporting base layer, which can be permeable, and a dual layer oxygen barrier film disposable over the supporting base layer. The supporting barrier film can include a polymeric or paper-based material. The dual layer oxygen barrier film can include a chitin material and a cellulosic material. The cellulosic material of the dual layer oxygen barrier film can be the same material as the permeable membrane or can be any other cellulosic material.

14 Claims, 12 Drawing Sheets

FIG. 3A
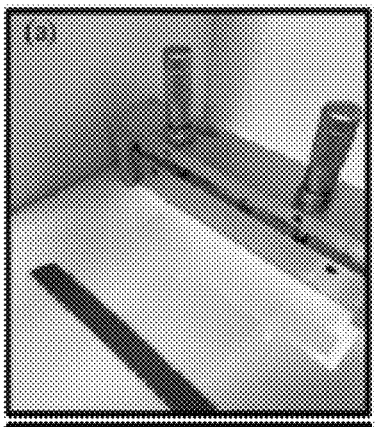
FIG. 3B
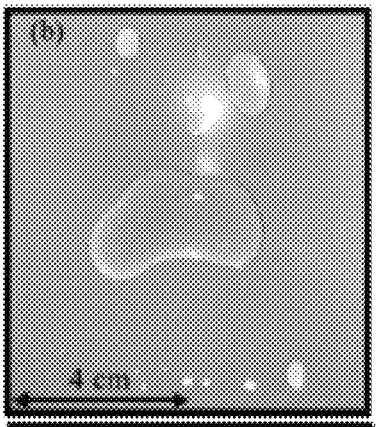
FIG. 3C
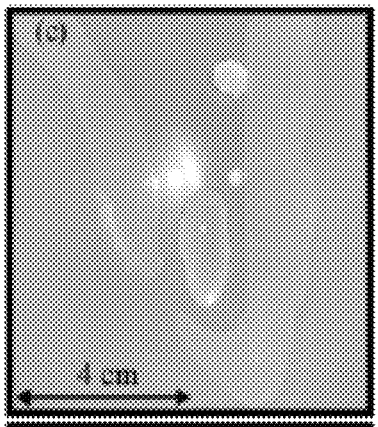
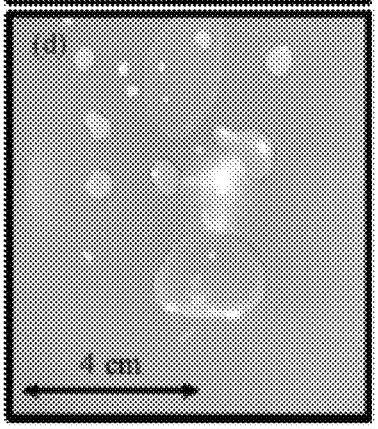
FIG. 3D
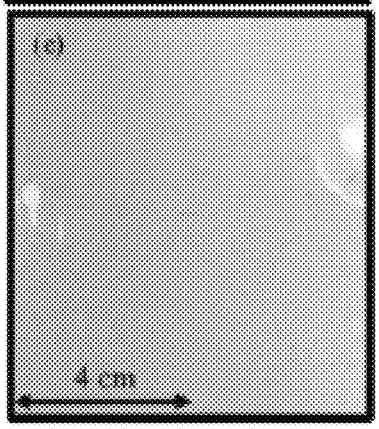
FIG. 3E
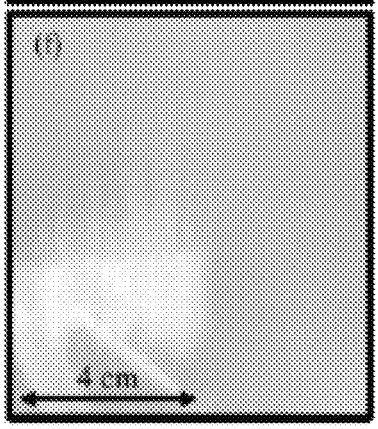
FIG. 3F FIG. 4A
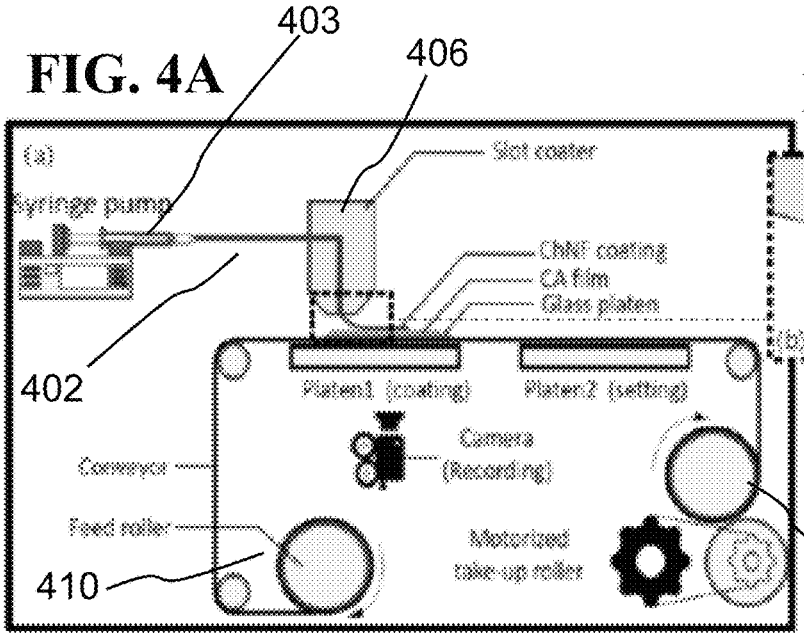
FIG. 4B
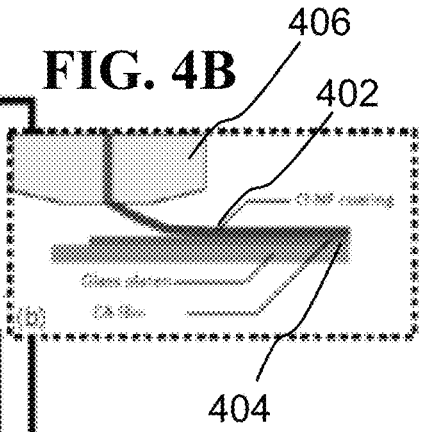
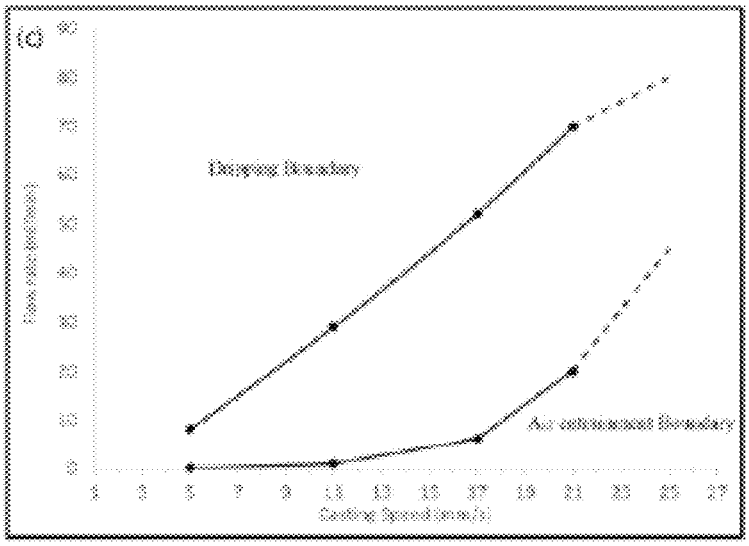
FIG. 4C
FIG. 4D
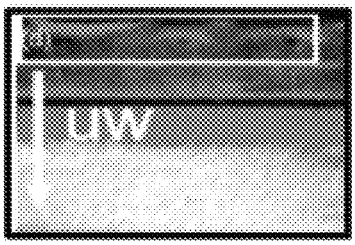
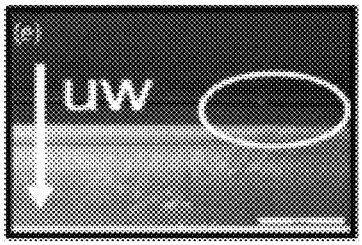
FIG. 4E FIG. 6A
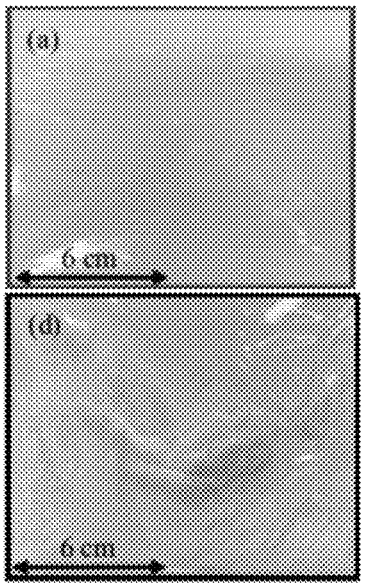
FIG. 6D
FIG. 6B
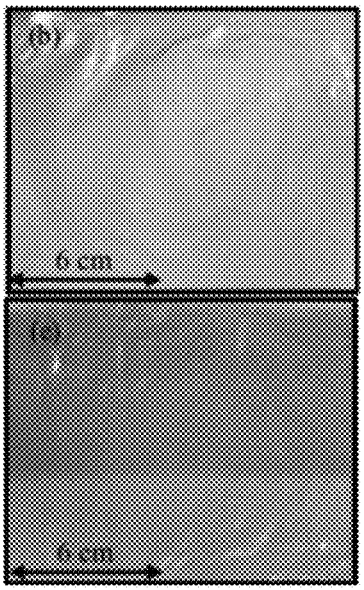
FIG. 6E
FIG. 6C
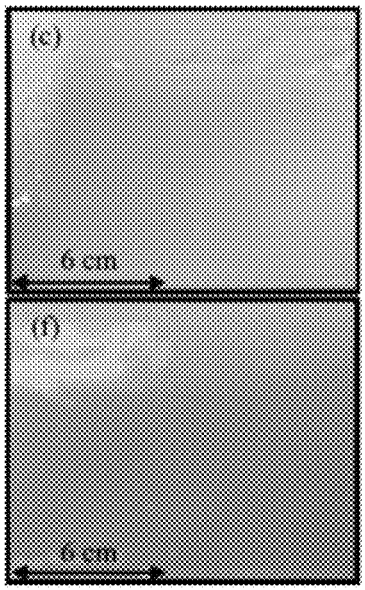
FIG. 6F FIG. 9A
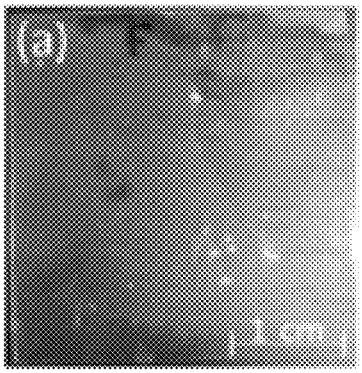
FIG. 9B
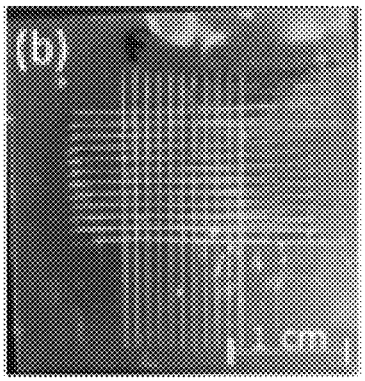
FIG. 9C
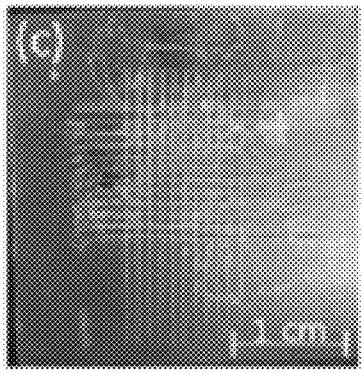
FIG. 9D
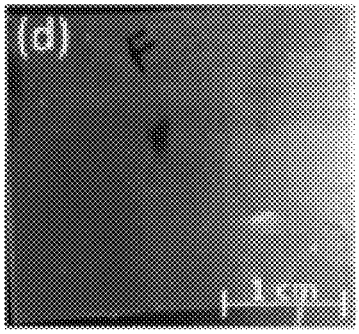
FIG. 9E
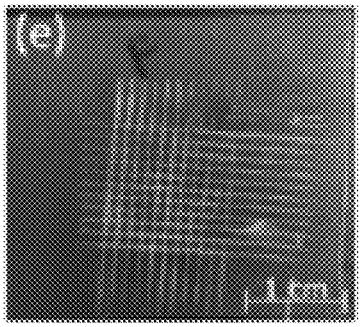
FIG. 9F
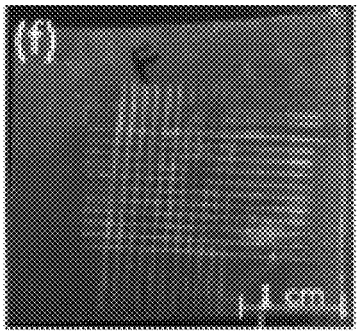
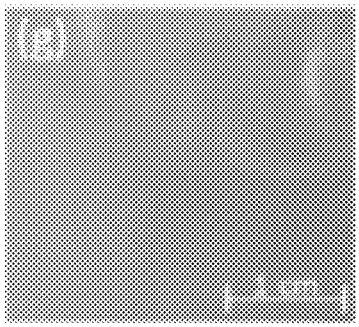
FIG. 9G
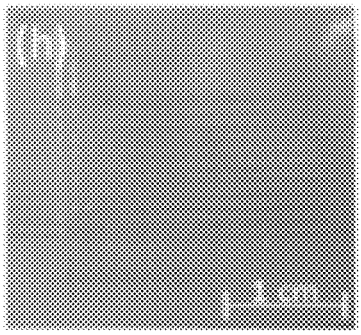
FIG. 9H
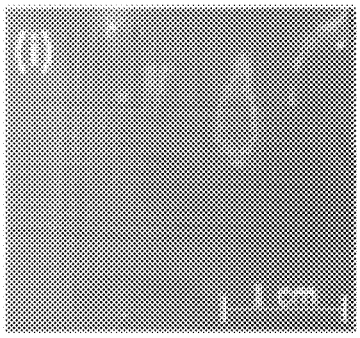
FIG. 9I

COATED MEMBRANES AND METHODS OF MAKING THE SAME

CROSS-REFERENCE TO RELATED APPLICATIONS

This application is a Continuation of U.S. patent application Ser. No. 18/048,587 filed 21 Oct. 2022, which claims the benefit of U.S. Provisional Application Ser. No. 63/270,586, filed on 22 Oct. 2021, each of which are incorporated herein by reference in their entireties as if fully set forth below.

STATEMENT OF RIGHTS UNDER FEDERALLY SPONSORED RESEARCH

This invention was made with government support under Award No. DE-EE0008494 by the Department of Energy. The government has certain rights in this invention.

FIELD OF THE DISCLOSURE

Embodiments of the present disclosure relate to coated membranes and methods of making the same. Particularly, embodiments of the present disclosure relate to dual layer coated membranes comprising cellulose and chitin coatings.

BACKGROUND

Cellulose and chitin nanomaterials have been studied extensively because they exhibit a high modulus tensile strength due to their high crystallinity, making them suitable materials for barrier films. Cellulose and chitin are two of the most abundant naturally produced biopolymers that are produced in nature in quantities of ~1011-1012 tons per year and 1010-1012 tons per year, respectively. Cellulose is mostly obtained from plants but can also be obtained from bacteria and tunicates. Chitin is a structural polysaccharide found in crustaceans, insects, and fungi. The properties deriving from the nanocrystalline or nanofibrous forms of these biopolymers have made them promising candidates for renewable, biodegradable materials for applications including primary barrier packaging for food, electronics, and pharmaceutical/medical products. The inability to melt-process cellulose and chitin as neat materials limits their manufacturability by packaging converters. However, the ease of suspending cellulose and chitin nanomaterials in water suggests their application as coatings to produce barrier films.

Various methods for fabricating cellulose nanocrystal (CNC) and chitin nanofiber (ChNF) films have been presented in the literature. CNC film fabrication has utilized techniques such as suspension casting using mechanical shear force, spin coating, and continuous processes such as slot die coating and micro gravure coating. Coating methods such as spray coating, regeneration from the gel using methanol and layer-by-layer deposition have been used for coating ChNF suspensions, specifically for biomedical applications and optical lenses.

Suspension casting and spray coating are very time consuming to achieve a uniform thickness film for suspensions with relatively high viscosity. Spin coating is not suitable to produce films continuously with large area. However, Roll-to-roll (R2R) manufacturing utilizing slot die coating offers solutions to these problem as it is scalable, inexpensive, and fast continuous processing.

Thus, there is a need for producing biodegradable barrier films with desirable oxygen permeation in a scalable manner.

BRIEF SUMMARY

Embodiments of the present disclosure relate to coated membranes and methods of making the same. Particularly, embodiments of the present disclosure relate to dual layer coated membranes comprising cellulose and chitin coatings.

An exemplary embodiment of the present disclosure provides a membrane including a supporting base layer, which can be permeable, and a dual layer oxygen barrier film disposable over the supporting base layer. The supporting barrier film can include a polymeric or paper-based material. The dual layer oxygen barrier film can include a chitin material and a cellulosic material. The cellulosic material of the dual layer oxygen barrier film can be the same material as the permeable membrane or can be any other cellulosic material.

In any of the embodiments disclosed herein, the dual layer oxygen barrier film can include a first layer at least partially made of a chitin material and disposable over the supporting base layer. The dual layer Oxygen barrier film can also include a second layer at least partially made from a cellulosic material and disposable over the first layer.

In any of the embodiments disclosed herein, the second layer of the dual layer oxygen barrier film can have a thickness that is at least ten times greater than a thickness of the first layer.

In any of the embodiments disclosed herein, the cellulosic material of the second barrier film layer can include cellulose nanocrystals ("CNC").

In any of the embodiments disclosed herein, the polymeric material of the supporting base layer can include a cellulosic material such as cellulose acetate ("CA").

In any of the embodiments disclosed herein, the chitin material can include chitin nanofibers ("ChNF").

In any of the embodiments disclosed herein, the first layer of the dual layer oxygen barrier film can include a solution of at least 0.5 wt % ChNF.

In any of the embodiments disclosed herein, the second layer of the dual layer oxygen barrier film can include a solution of at least 5 wt % CNC.

In any of the embodiments disclosed herein, a suspension from which the first layer of the dual layer Oxygen barrier film is coated can have a greater surface tension than a suspension from which the second layer of the dual layer Oxygen barrier film is coated.

In any of the embodiments disclosed herein, the membrane can have an oxygen permeation of less than 20 $cm^3$ $\mu m/m^2/day/kPa$ at 23° C. and 50% relative humidity.

In any of the embodiments disclosed herein, the membrane can have an oxygen permeation of less than 10 $cm^3$ $\mu m/m^2/day/kPa$ at 23° C. and 50% relative humidity.

In any of the embodiments disclosed herein, the membrane can have an oxygen permeation ranging from about 1 $cm^3$ $\mu m/m^2/day/kPa$ to about 9 $cm^3$ $\mu m/m^2/day/kPa$ at 23° C. and 50% relative humidity.

Another exemplary embodiment of the present disclosure provides a method of making a membrane that can include coating a permeable base layer with a dual layer oxygen barrier film to form the membrane. The coating can include a roll-to-roll coating process. The membrane can have an oxygen permeation less than 20 $cm^3$ $\mu m/m^2/day/kPa$ at 23° C. and 50% relative humidity.

In any of the embodiments disclosed herein, the roll-to-roll coating process can include feeding the supporting base layer from a feed roller to a take up roller, flowing at least one coating material through a dual slot die, and depositing the at least one coating material over the supporting base layer.

In any of the embodiments disclosed herein, the process of flowing the at least one coating material through the slot die can include flowing a first fluid through a first slot in the dual slot die at a flow rate of 2-6 ml/min and flowing a second fluid through a second slot in the dual slot die at a flow rate for 20-30 ml/min.

In any of the embodiments disclosed herein, prior to coating the supporting base layer, ultraviolet treatment can be performed on the supporting base layer for at least 5 minutes.

In any of the embodiments disclosed herein, the ultraviolet treatment can occur at a temperature between about 40° C. to about 70° C.

In any of the embodiments disclosed herein, after coating the supporting base layer, a drying process can be performed.

In any of the embodiments disclosed herein, the drying process can include exposing the membrane to a vacuum oven preheated to a temperature range of from about 60° C. to about 100° C.

A further exemplary embodiment of the present disclosure provides a biodegradable barrier material including a supporting base layer at least partially made of a cellulosic material, and a dual barrier film. The dual barrier film can include a barrier film layer coated from a first acidic solution layer disposable over the supporting base layer comprising an amine group and a second barrier film layer coated from a second acidic solution layer disposable over the first acidic solution layer comprising a sulfate group. The first acidic solution layer can have a greater surface tension than the second acidic solution layer. The biodegradable barrier material can have an oxygen permeation less than 20 $cm^3$ $\mu m/m^2$/day/kPa at 23° C. and 50% relative humidity.

Another exemplary embodiment of the present disclosure provides a method of making a membrane, which can include coating a permeable base layer with a barrier film layer to form the membrane, where the coating can include a roll-to-roll coating, and wherein the membrane has an oxygen permeability at 23° C. and 50% relative humidity increase by 20 times or greater compared to a spray coating of the membrane.

In any of the embodiments disclosed herein, the dual layer barrier film can comprise a chitin material.

These and other aspects of the present disclosure are described in the Detailed Description below and the accompanying figures. Other aspects and features of embodiments of the present disclosure will become apparent to those of ordinary skill in the art upon reviewing the following description of specific, exemplary embodiments of the present invention in concert with the figures. While features of the present disclosure may be discussed relative to certain embodiments and figures, all embodiments of the present disclosure can include one or more of the features discussed herein. Further, while one or more embodiments may be discussed as having certain advantageous features, one or more of such features may also be used with the various embodiments of the invention discussed herein. In similar fashion, while exemplary embodiments may be discussed below as device, system, or method embodiments, it is to be understood that such exemplary embodiments can be implemented in various devices, systems, and methods of the present disclosure.

BRIEF DESCRIPTION OF THE DRAWINGS

The accompanying drawings, which are incorporated in and constitute a part of this specification, illustrate multiple embodiments of the presently disclosed subject matter and serve to explain the principles of the presently disclosed subject matter. The drawings are not intended to limit the scope of the presently disclosed subject matter in any manner.

FIGS. 3A-F illustrates images of (FIG. 3A) the blade coating apparatus and blade coated samples: (FIG. 3B) 0.5 wt % ChNF on an untreated CA film, (FIG. 3C) 0.5 wt % CNC on an untreated CA film, (FIG. 3D) 0.5 wt % CNC on CA film UV-treated at 70° C. for 5 minutes, (FIG. 3E) 0.5 wt % ChNF on CA film UV-treated at 70° C. for 5 minutes, and (FIG. 3F) 8 wt % CNC on CA film UV-treated at 70° C. for 5 minutes in accordance with an exemplary embodiment of the present invention.

FIG. 4A illustrates a schematic of single layer slot die coating, in accordance with an exemplary embodiment of the present invention, FIG. 4B illustrates a callout of the lower section of the slot die, in accordance with an exemplary embodiment of the present invention, FIG. 4C illustrates a coating window of 0.5 wt % ChNF on UV treated CA film, in accordance with an exemplary embodiment of the present invention, FIG. 4D illustrates an example of the dripping effect, and FIG. 4E illustrates an example of air entrainment, in accordance with an exemplary embodiment of the present invention.

FIGS. 6A-F illustrates pictures of dual layer coated films of 0.5 wt % ChNF and 8 wt % CNC dried under various humid conditions, in accordance with an exemplary embodiment of the present invention: FIG. 6A in air at room temperature, FIG. 6B at 60° C. for 60 minutes, FIG. 6C at 80° C. for 20 minutes, and FIG. 6D at 100° C. for 30 minutes, without desiccant, illustrating liquid pooling, deformation, and a chemical reaction. In addition to sample dried in dry conditions with desiccant FIG. 6E in air and FIG. 6F in an oven at 80° C. for 15 mins with desiccant.

FIGS. 7A-C illustrates EDS line scans of multilayer films, in accordance with an exemplary embodiment of the present invention, consisting of: FIG. 7A CNC layer on cellulose acetate, FIG. 7B ChNF layer on cellulose acetate, and FIG. 7C a tri-layer assembly consisting of CNC and ChNF layers on cellulose acetate. The data are overlayed on SEM micrographs showing the region from which the data were collected.

FIGS. 9A-I illustrates Adhesion test results of various film treatments, in accordance with an exemplary embodiment of the present invention: (FIGS. 9A-C) oven and (FIGS. 9 D-F) air-dried slot die dual-layer ChNF/CNC on UV-treated CA film and (FIGS. 9 G-I) spray-coated ChNF/CNC coating on untreated CA film. The unscratched films are shown in panels (FIG. 9A), (FIG. 9D), and (FIG. 9G). The scratched films are shown in panels (FIG. 9B), (FIG. 9E), and (FIG. 9H). The tested films are shown in panels (FIG. 9C), (FIG. 9F), and (FIG. 9I), where the classification results are 1B, 4B, and 0B for the oven- and airdried slot-coated samples and spray-coated sample, respectively, in accordance with an exemplary embodiment of the present invention.

(FIG. 10A) spray-coated CA-ChNF/CNC film, (FIG. 10B) slot die-coated oven-dried CA-ChNF/CNC film, and (FIG. 10C) slot-die coated air-dried CA-ChNF/CNC film.

DETAILED DESCRIPTION

Figure 1A:
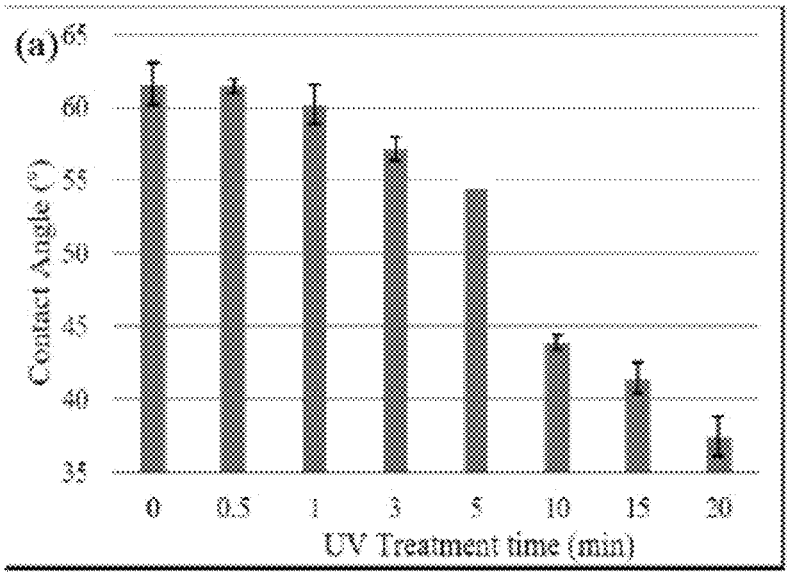
FIGS. 1A and 1B illustrate plots of a contact angle of 0.5 wt % ChNF suspension on UV treated CA as a function of (FIG. 1A) UV treatment time and (FIG. 1B) UV treatment temperature, in accordance with an exemplary embodiment of the present invention.

Although certain embodiments of the disclosure are explained in detail, it is to be understood that other embodiments are contemplated. Accordingly, it is not intended that the disclosure is limited in its scope to the details of construction and arrangement of components set forth in the following description or illustrated in the drawings. Other embodiments of the disclosure are capable of being practiced or carried out in various ways. Also, in describing the embodiments, specific terminology will be resorted to for the sake of clarity. It is intended that each term contemplates its broadest meaning as understood by those skilled in the art and includes all technical equivalents which operate in a similar manner to accomplish a similar purpose.

Herein, the use of terms such as "having," "has," "including," or "includes" are open-ended and are intended to have the same meaning as terms such as "comprising" or "comprises" and not preclude the presence of other structure, material, or acts. Similarly, though the use of terms such as "can" or "may" are intended to be open-ended and to reflect that structure, material, or acts are not necessary, the failure to use such terms is not intended to reflect that structure, material, or acts are essential. To the extent that structure, material, or acts are presently considered to be essential, they are identified as such.

By "comprising" or "containing" or "including" is meant that at least the named compound, element, particle, or method step is present in the composition or article or method, but does not exclude the presence of other compounds, materials, particles, method steps, even if the other such compounds, material, particles, method steps have the same function as what is named.

It is also to be understood that the mention of one or more method steps does not preclude the presence of additional method steps or intervening method steps between those steps expressly identified.

The components described hereinafter as making up various elements of the disclosure are intended to be illustrative and not restrictive. Many suitable components that would perform the same or similar functions as the components described herein are intended to be embraced within the scope of the disclosure. Such other components not described herein can include, but are not limited to, for example, similar components that are developed after development of the presently disclosed subject matter.

Slot die coating is one of the most useful methods utilized in the current coating industry because it can fabricate precisely controlled thin uniform coatings over a moving substrate. There are various forms of slot die coating such as single wide-area, dual layer, stripe, and patch. Regardless of which version of the process is utilized, an understanding of the fluid properties and drying pre and post deposition, respectively, is useful in order to process a stable film. To manage the stability of the film, a range of processing parameters (e.g., flow rate and/or substrate speed) for the coating liquid is often developed, which forms the processing boundary for uniform defect-free film, called a coating window. Although, single layer slot die coating windows typically can be smaller than those of a dual layer coating, knowledge from the single layer coating window, can provide a first approximation of where stable coatings will be obtained. Moreover, dual layer slot die coating can be challenging, because it can be subject to different flow, interfacial, and drying instabilities that may affect the quality of the final bilayer film.

Although ChNF and CNC suspensions have been constituent materials in bilayer and multilayer thin films, slot coating of these materials have been lesser studied. The processing of CNCs has been limited to single layer slot die coating and ChNFs to laboratory scale processes such as layer-by-layer. However, these suspensions have been constituent materials in bilayer and multilayer thin films. One conventional technique coated CNC and poly diallyl dimethylammonium chloride onto glass utilizing layer-by-layer method. Another conventional technique fabricated antithrombus coatings using ChNF and heparin by layer-by-layer method. To fabricate multilayer materials that include CNC, manufacturing approaches have been limited to independent steps that are carried out in multiple stages, sometimes enabled by R2R, with drying steps between each subsequent coating, example combinations include: multiple slot die coaters that coat single film separately and reverse gravure, slot die coating and extrusion. Because the ChNFs can be in acidic solutions due to the amine groups and the CNCs can be anionic due to the sulfate groups, it is understood that there exists an electrostatic attraction between them that can lead to synergistic interaction and enhanced oxygen barrier performance compared to individual CNC or ChNF Films.

The performance of the substrate, especially the oxygen barrier property can be enhanced by applying coatings containing ChNFs and CNCs. A conventional technique obtained poly(lactic acid) films with alternating ChNF and CNC coatings by spray coating and the ChNF/CNC multilayers resulted in a decrease of up to 73% in the oxygen permeability (OP) comparing to the neat substrate. The blend of ChNF and CNC has been found to take advantage of the electrostatic attraction between ChNF and CNC to form dense fiber networks, and an addition of 25 wt % ChNF to CNC led to a 91% decrease in OP. Another conventional technique spray coated 20 bilayers of chitin nanowhiskers and cellulose nanofibers on poly(ethylene terephthalate) (PET) and the OP of the film was reduced ~97%. Another conventional technique deposited 30 bilayers of chitosan, which is highly deacetylated chitin, and CNCs on PET by dip coating and the OP decreased ~92%. However, no studies have been reported on a continuous R2R slot die coating of both ChNF and CNC layers simultaneously.

Wetting of the coating fluid on a substrate has been well studied, including for roll-to-roll systems. Analysis of the interfacial phenomena between the solid and liquid surfaces can play a vital role in establishing the coating window. After establishing the coating window, the approximate thickness of the final product can be quickly predicted based on the relationship between flow rate and substrate velocity, which can be beneficial for controlling the structure and properties of the resulting film. The structure-property relationship can directly affect the performance of the final thin film. For instance, a conventional study showed that the oxygen permeability and carbon dioxide permeability of CNC can depend upon the packing factor and degree of anisotropy, based on a modified Bharadwaj model and experimentation. Wetting of a fluid on another liquid has been studied. In this case, for miscible fluids, surface tension can be balanced to obtain stable coating and avoid dewetting due to nonuniform layer composition caused by diffusion. The impact of dual layer coating on the functionality of biodegradable materials that exhibit different structure and properties has not been demonstrated.

A continuous roll-to-roll coating method to fabricate polysaccharide-based oxygen barrier films can significantly reduce the permeability of the film, compared to state-of-the-art processes and materials. The cellulose and chitin nano material barrier films can be fabricated using two methods for comparison, lab scale spray coating of each layer individually and pilot scale dual layer slot die coating of each layer simultaneously. CNC and ChNF can be materials in the respective film layers. The wetting and rheological properties of the materials can be evaluated and tuned. A partial coating window can be established for the ChNF suspension, to provide a first approximation of good coating conditions for the dual layer slot die coating process for a desired film thickness. The drying conditions can also be tuned, to minimize the impact on film morphology and to retain desired barrier film properties. The OP of CNC/ChNF barrier film can be significantly improved, compared to spray coated CNC/ChNF barrier film and polyethylene terephthalate (PET), when a dual layer coating process is used, which may be due to changes in morphological and chemical properties.

Additionally, a roll-to-roll system can be used to fabricate single layer and bilayer thin films using a standard single cavity slot die and a dual layer slot die, respectively. The R2R system can comprise a carrier film wrapped around a feed roller and a motorized take-up roller to control the substrate speed (uw) and a multi-unit syringe pump to control the flow rate (Q) of the suspensions. A substrate assembly can include pieces of substrate taped onto a glass plate placed on top of the carrier film. The substrate can include a cellulose material such as CA. The substrate speed can be set to a constant value. A slot die coater (either a standard slot die or a dual layer slot die) can be placed above the substrate assembly with a coating gap between the slot die and the substrate. Two parallel plates of a standard slot die can be offset by a shim. For dual layer slot dies the two end plates can each be offset by two shims with a flat plate sandwiched in the middle. The standard and dual layer slot dies can be connected to one or two syringe(s) mounted on the syringe pump, respectively, either containing chitin nanomaterial and/or cellulose suspensions. The flow rate of each suspension can be set between individually during the die coating process.

A partial coating window for a material can be determined using the standard slot die, to determine the defect-free coating region, based on the material properties, substrate speed and flow rate. To achieve this, the coating process can be constantly monitored with a camera and microscope housed beneath a transparent platen. This setup can allow the dynamic wetting line to be constantly visualized. The captured video can be analyzed to determine when the wetting line became unstable, causing defects such as air entrainment or dripping, thus identifying the velocity and flow rate limits. The instability can be found by increasing the flow rate for a given substrate speed or vice versa.

After coating, the barrier samples can be either placed in a semi-enclosed area for air drying or in a preheated oven. When air-dried, the samples can be placed in a hood for 2 h to dry or placed inside an enclosure with or without calcium chloride crystals as desiccant (Damprid used as purchased from Lowes, Inc.). When oven-dried, the samples can be placed into a pre-heated vacuum oven for with or without desiccant, at a constant or varying temperature.

FIG. 4A provides a schematic of an exemplary method for single slot dye coating 400 involving the disposal for a single barrier film layer 402 upon a supporting base layer 404. The single barrier film layer 402 comprises a ChNF coating. The supporting base layer 404 comprises a CA film. At the outset of the method, a solution for the single barrier film layer composition 402 resides within a syringe pump 403. The syringe pump 403 injects the solution for single barrier film layer composition 402 into a single slot die coater 406 through a slot therein. The solution for the single barrier film layer composition 402 flows through the slot such that the solution for the single barrier film layer composition 402 can exit the single slot die coater 406 in a coating window at a controlled speed and angle onto the supporting base layer 404. The supporting base layer 404 slides perpendicular to the single slot die coater 406 such that the solution for the single barrier film layer composition 402 exiting the slot die coater 406 may spread across the supporting base layer 404. The supporting base layer 404 sits on a conveyer, moving as the conveyer unravels from around a feed roller 410 and an onto a motorized take-up roller 412 at the opposite end of the feed roller 410. Once the supporting base layer 404 with the solution for the single barrier film layer composition 402 disposed upon exits the coating window, the solution for the single barrier film layer compositions 402 can undergo a drying process forming the dual barrier film.

FIG. 4B provides a schematic for a magnified coating window of the exemplary method displayed in FIG. 4A. The solution for the single barrier film layer composition comprising the ChNF coating 402 exits the single slot die coater 406 and deposits upon the supporting base layer comprising CA film 404.

Figures 5A, 5B, 5C, 5D, 5E:
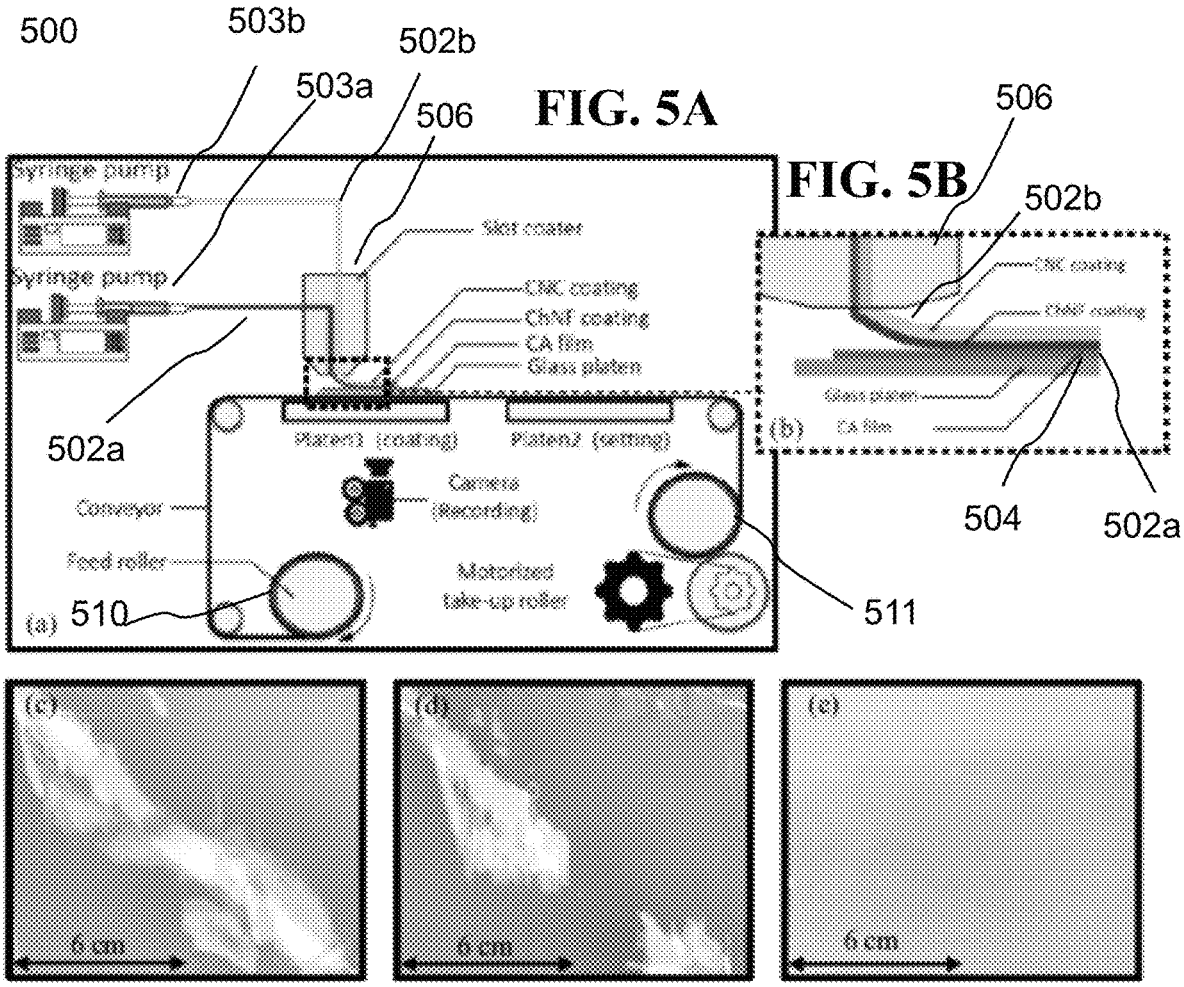
FIG. 5A illustrates a schematic of dual layer slot die coating on a R2R, in accordance with an exemplary embodiment of the present invention.
FIG. 5B illustrates a close-up of the dual layer slot die lip, and wet 0.5 wt % ChNF ad 8 wt % CNC dual layer coatings on UV treated CA film for 5 min under different UV treatment temperature, in accordance with an exemplary embodiment of the present invention.
FIG. 5C illustrates treatment temperature at 40° C., in accordance with an exemplary embodiment of the present invention.
FIG. 5D illustrates treatment temperature at 60° C., in accordance with an exemplary embodiment of the present invention.
FIG. 5E illustrates treatment temperature at 70° C. in accordance with an exemplary embodiment of the present invention.

FIG. 5A provides a schematic of an exemplary method for dual slot dye coating 500 involving the disposal for two solutions for the barrier film layers 502*a* and 502*b* upon a supporting base layer 504. The first solution for the first barrier film layer 502*a* comprises a ChNF coating while the second solution for second barrier film layer 502*b* comprises a CNC coating. The supporting base layer 504 comprises a CA film. At the outset of the method, the two solutions for the barrier film layer compositions 502*a* and 502*b* reside within a pair of respective syringe pumps 503*a* and 503*b*. The syringe pumps 503*a* and 503*b* inject the solutions for the barrier film layer compositions 502*a* and 502*b* into a dual slot die coater 506 through two slots therein. The two solutions for barrier film layer compositions 502*a* and 502*b* each flow through respective slots such that the solutions for the barrier film layers compositions 502*a* and 502*b* can exit the dual slot die coater 506 in a coating window at controlled speeds and angles onto the supporting base layer 504. The supporting base layer 504 slides perpendicular to the dual slot die coater 506 such that the two solutions for the barrier film layer compositions 502*a* and 502*b* exiting the slot die coater 506 may spread across the supporting base layer 504. The supporting base layer 504 sits on a conveyer, moving due to the unraveling of the conveyer 504 from around a feed roller 510 and an onto a motorized take-up roller 512 at the opposite end of the feed roller 510. Once the supporting base layer 504 with the solutions for the barrier film layer compositions 502*a* and 502*b* disposed upon exits the coating window, the solutions for the barrier film layer compositions 502*a* and 502*b* can undergo a drying process forming the dual barrier film.

FIG. 5B provides a schematic for a magnified coating window of the exemplary method displayed in FIG. 5A. The solution for the barrier film layer composition comprising the ChNF coating 502*a* first exits the dual slot die coater 506 and deposits upon the supporting base layer comprising CA film 504. The solution for the barrier film layer composition comprising the CNC coating 502*b* next exits the dual slot die coater 506 and deposits upon the previously exited solution for the barrier film layer composition comprising the ChNF coating 502*a*.

EXAMPLES

Reference will now be made in detail to exemplary embodiments of the disclosed technology, examples of which are illustrated in the accompanying drawings and disclosed herein. Wherever convenient, the same references numbers will be used throughout the drawings to refer to the same or like parts.

All chemicals and gases were purchased from commercial suppliers and used without further purification unless otherwise noted. The following list is not the only place such products could be purchased but merely represents areas products used in these examples. Crab shells were purchased from Neptune's Harvest (Gloucester, MA). Sodium hydroxide (NaOH, ACS grade) was purchased from VWR (Radnor, PA), and hydrochloric acid (HCl, ACS grade) and acetic acid (HOAc, ACS grade) were purchased from Sigma-Aldrich (St. Louis, MO). Cellulose acetate (CA) film with a thickness of 75 gm was purchased from Goodfellow Cambridge Ltd. (Huntingdon, UK). CNCs as a 10.0 wt % aqueous suspension were provided by the USDA Forest Products Laboratory (Madison, WI). The CNCs had 1.06 wt % sulfate content with Nat counterions. The CNC suspension was diluted to different concentrations by addition of deionized (DI) water.

The extraction of ChNFs was carried out based on previous studies. Briefly, the flakes of crab shells can be treated with 5 wt % NaOH solution and 7 wt % HCl solution to remove proteins and minerals, respectively. The pre-treated crab shells can then be deacetylated with 35 wt % NaOH solution to yield chitin. The chitin can then be ground into powder (<600 inn) using a grinder (such as the DCG-20N, Cuisinart, Stamford, CT) and dispersed into DI water to yield a 0.5 wt % suspension. The suspension can be acidified using HOAc to pH of 3.0 and then homogenized using a Mini DeBEE Homogenizer (BEE International, South Easton, MA). The homogenization process can be first carried out at 19,800 psi for 20 passes with a 0.008" nozzle and then at 29,800 psi for 10 passes with a 0.005" nozzle. The resulting suspension could then be used for characterization and coating.

Contact angles between the 0.5 wt % ChNF suspension and the CA film and ultraviolet (UV) treated CA film (substrates), stainless steel, aluminum, and acrylic (possible slot die tooling materials) can be measured to assess the wetting properties of the materials. The UV treatment for the CA can be carried out using a Pro Series Digital UV Ozone system. The treatment time of the CA film could vary from 30 sec up to 15 min at room temperature. In addition, UV treatment temperature could vary from 23-100° C. for 5 min treatment times. Contact angle measurements can be made using a Rame-Hart® 500 goniometer at a room temperature utilizing the sessile drop method following the ASTM 7334 standard. A disposable syringe and needle can be filled with 10 mL of the ChNF suspension; then, 4 μL of the suspension can be automatically dispensed onto the substrate and the measurement was made. This was repeated 10 times and the average calculated. The surface tension was measured using the pendant drop method on the same instrument at room temperature. ASTM 7490 was followed to make the measurement. In this case, the 4 μL droplet of suspension remained stable on the tip of the needle while the measurement was recorded. This was repeated 10 times and averaged.

The viscosity of the 0.5 wt % ChNF suspension was characterized using a rheometer (AR-2000EX, TA instrument) with a geometry of 25-mm parallel plate and a gap distance of 500 μm.

The degree of acetylation (DA) of the ChNF was determined by potentiometric titration using a pH meter (such as the Seven Excellence S400, Mettler Toledo).

Contact angles between the 0.5 wt % and/or 8 wt % CNC suspensions and the CA film, UV treated CA film and ChNF barrier film (substrates), stainless steel, aluminum, and acrylic (possible slot die tooling materials) were measured to assess the wetting properties of the materials. The contact angle and surface tension of 0.5 wt % and 8 wt % CNC suspensions were measured using the same methods described for ChNF.

The viscosities of the 0.5 wt % and the 8 wt % CNC suspensions were characterized using the same method described for ChNF.

The spray-coated sample was prepared using a spray gun (such as the Central Pneumatic, GA) which had a 1.52 mm nozzle and was connected to a liquid reservoir containing the suspensions. The spray gun was connected to a nitrogen gas cylinder at 35 psi. A volume of 50 mL of 0.5 wt % ChNF or 0.5 wt % CNC suspension was sprayed in sequence on a 7.5"×7.5" CA film which was fixed to a hot plate at 65° C. The spray gun moved in a zigzag pattern, and after each spray of a single layer, the coating was dried for ~2 min.

Doctor blade coating was used to fabricate the single layer thin films with a 10 cm width blade having an offset height of 20 μm above the substrate. Untreated CA film and UV treated CA film were cut into 5 cm by 3 cm coupons and taped onto a glass platen, to be used as the substrate. Approximately 5 mL of liquid was pipetted onto a substrate and dragged across the substrate to produce a uniform thick material, at the room temperature. The liquids included ChNF 0.5 wt % and various concentrations of CNC up to 8 wt %, to tune the concentration of the solution for the optimal wetting.

A roll-to-roll (R2R) system was used to fabricate single layer and bilayer thin films using a standard single cavity slot die and a dual layer slot die, respectively. The R2R system consisted of a polyethylene terephthalate (PET) carrier film wrapped around a feed roller and a motorized take-up roller to control the substrate speed (uw) and a multi-unit syringe pump to control the flow rate (Q) of the suspensions. A substrate assembly consisting of a 4"×4" pieces of CA substrate taped onto a 6"×6" glass plate was placed on top of the PET carrier film. The substrate speed was set to a constant value between 5-21 mm/s. A slot die coater (either a standard slot die or a dual layer slot die) was placed above the substrate assembly with a coating gap of 200 μm. The standard as configured with two parallel plates offset by a shim. The dual layer slot dies can be configured with two end plates each offset by two shims with a flat plate sandwiched in the middle. The standard and dual layer slot dies can be connected to one or two syringe(s) mounted on the syringe pump, respectively, either containing ChNF and/or CNC suspensions. The flow rate of each suspension can be set between 0.05-70 ml/min for ChNF and the standard slot die and to 2-6 ml/min and 20-30 ml/min, respectively, during the dual layer slot die coating process.

A partial coating window for ChNF was determined using the standard slot die, to determine the defect-free coating region, based on the material properties, substrate speed and flow rate. To achieve this, the coating process can be constantly monitored with a camera and microscope housed beneath a transparent platen. This setup allowed the dynamic wetting line to be constantly visualized. The captured video can be analyzed to determine when the wetting line became unstable, causing defects such as air entrainment or dripping, thus identifying the velocity and flow rate limits. The instability was found by increasing the flow rate for a given substrate speed or vice versa.

After coating, the samples were either placed in a semi-enclosed area for air drying or in a preheated oven. When air-dried, the samples were placed in a hood for 2 h to dry or placed inside an enclosure with or without calcium chloride crystals as desiccant (a conventional study used as purchased from Lowes, Inc.). When oven-dried, the samples were placed into a pre-heated vacuum oven for 15-60 min with or without desiccant, at a constant temperature ranging from 60-100° C.

The thickness of the samples was measured using a micrometer and by using SEM.

Dried single layer and bilayer thin films were cut into 5 mm by 3 mm coupons. These samples were mounted in acrylic mold compound (Castamount, Pace Technologies). The surface of the acrylic mold was ground and smoothed with sandpaper, and then gold sputtered for 30 seconds. Then SEM images were captured using a Phenom® ProX desktop SEM. For each sample, the film thickness was calculated by taking 10 measurements at different points across the SEM cross section and averaging the data.

Otherwise, the thicknesses of the films were also measured with a micrometer (Coolant Proof Micrometer Series 293, Mitutoyo, USA). Ten measurements were made for each sample and averaged.

The oxygen transmission rates (OTR) of selected films were characterized by using an oxygen transmission system (OX-TRAN 1/50, MOCON, Brooklyn Park, MN). Film samples of ~3 cm×3 cm were cut off, sandwiched between two pieces of aluminum mask, and tested at 23° C., 50% relative humidity (RH) of the oxygen (test gas) side, and 0% RH for the nitrogen (carrier gas) side under convergence mode. The OP was calculated using the equation: $OP=OTR\times h/\Delta p_{O_2}$ where h is the film thickness and $\Delta p_{O_2}$ is the difference in partial pressure of $O_2$ at either side, which was 101.325 kPa.

Samples were prepared for cross-sectional SEM analysis by freeze-fracturing. Sections were first immersed in liquid nitrogen and then then cleaved by cutting the edge with a razor blade and then pulling the sample to propagate the break. The fractured samples were mounted onto aluminum stubs using conductive double-sided carbon tape and sputter-coated with 7 nm of Ir. Imaging was performed using a Quanta 400 FEG instrument (FEI, USA) with accelerating voltages ranging from 5-25 keV.

Samples prepared for SEM imaging were used for Energy Dispersive X-ray Spectroscopy (EDS) analysis using an EDAX Elements EDS system integrated within the Quanta 400 FEG instrument. Line scans were performed to span the width of the cross-sectional films across a distance of 50-60 inn. Data were collected every 200 nm using a dwell time of 0.05 seconds. At least 16 line scans were averaged for each sample. Scans were collected at a magnification of 1000× using an accelerating voltage of 10 keV was used for SEM imaging and EDS data collection.

The contact angles between the suspensions and untreated CA film, shown in Table 1, ranged from 55 to 65°, values that can result in de-wetting during the coating process. After conducting a preliminary experiment to verify the wetting behavior, it was observed that 0.5 wt % ChNF and 0.5 wt % CNC de-wetted as-purchased CA film. To enhance the wettability between the substrate and coating solutions, the CA film was UV-treated, since chemically altering the suspensions was less desirable.

Figure 1B:
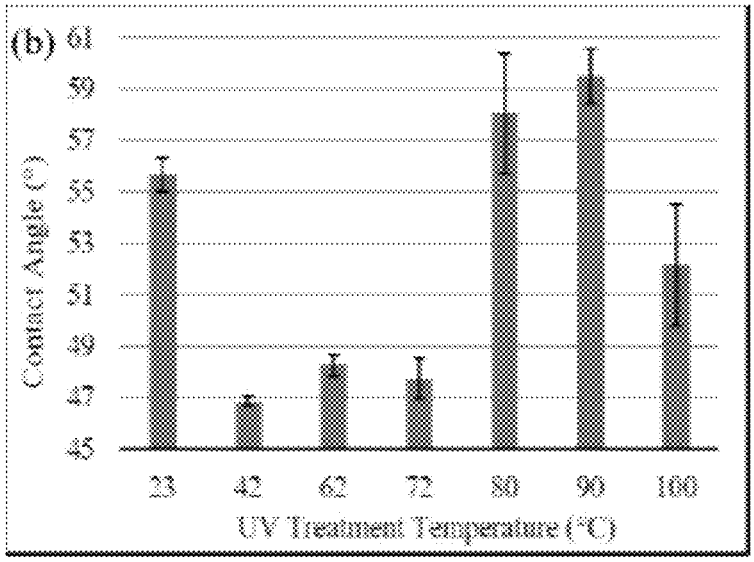

The bather film was structured such that ChNF was sandwiched between CNC and the UV-treated CA film. The effect of UV treatment time and temperature on the wetting was analyzed for the ChNF suspension, since it was in direct contact with the CA film. As illustrated in FIG. 1A, there was a significant decrease in the contact angle when the UV treatment time surpassed 5 min, which agrees with previous studies. As illustrated in FIG. 1B, a significant drop in the contact angle was observed when the treatment temperature was between 40-70° C. However, at 80° C. the contact angle sharply increases and again decreased when the UV treatment temperature is 100° C. Fluctuations in the wetting behavior of the ChNF film coated on UV-treated CA was due to deformation of the CA film as its upper working temperature, which is 55-95° C., was exceeded. Considering the limitation of the CA film and the scalability of the continuous process, the optimal UV treating condition was chosen as 40° C. for 5 minutes. After the UV treatment, the contact angle reduced by 33% for ChNF and the UV-treated CA, from 56.3 to 37.4, leading to good wetting post coating.

Figure 2:
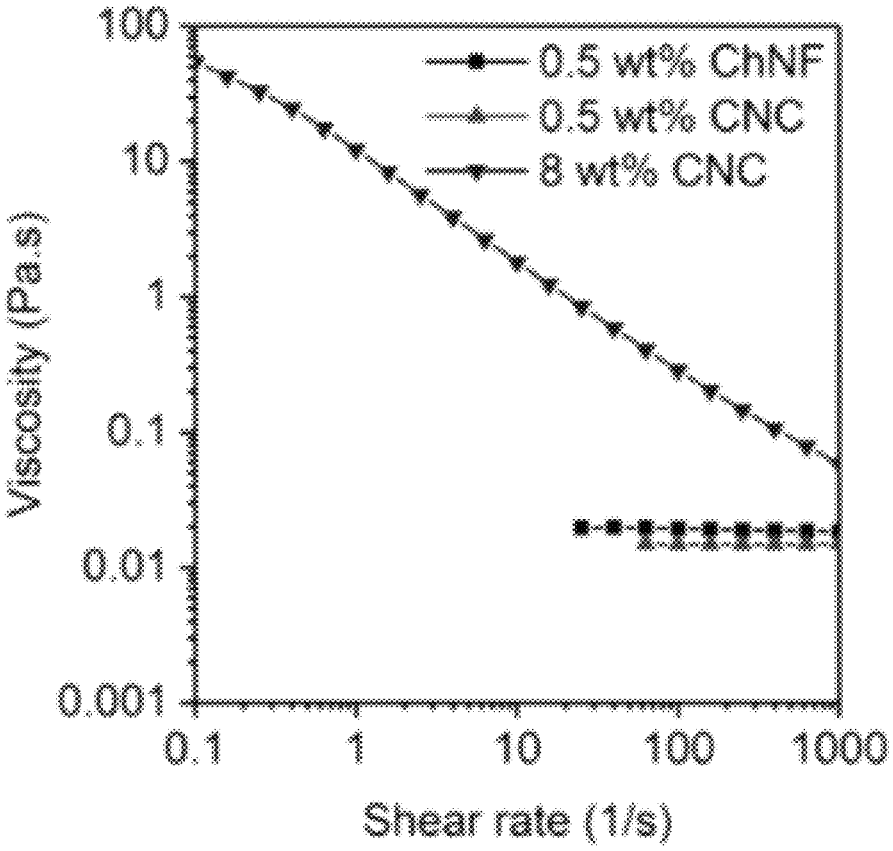
FIG. 2 illustrates a plot of viscosities of 0.5 wt % ChNF, 0.5 wt % CNC, and 8 wt % CNC suspensions as a function of shear rate, in accordance with an exemplary embodiment of the present invention.

To obtain single layers of 0.5 wt % CNC, it was coated on untreated and UV-treated CA films. The suspension dewetted both films leading to additional tuning of the suspension. Kaboorani et al. showed that increasing the concentration of CNC suspensions lead to good coating on stainless steel with a blade coater. Thus, the concentration of CNC was increased up to 8 wt %, which lead to a more stable coating. The contact angle was measured on UV-treated CA and untreated dry ChNF films. Single layer CNC film coated onto UV-treated CA and untreated dry ChNF films were used to support characterization of the dual-layer films below, as a reference. It was observed that as the CNC concentration increased, the contact angle on UV-treated CA increased. This was likely due to the gel-like structure of these concentrated suspensions, which can/are known to introduce elasticity. It was found that the 8 wt % CNC wetted the ChNF dry film, despite the contact angle being relatively high (Table 1). It is likely that the avoidance of dewetting for the 8 wt % CNC suspension is a result of its relatively high viscosity, discussed below with FIG. 2, which slows dewetting progress during casting and drying. Having a high contact angle may lead to easier delamination and less adhesion between CNC and ChNF, which would be desired for easy extraction and analysis in this study.

TABLE 1

Contact angle measurements of CNC and ChNF suspensions on various surfaces

| | Untreated CA film | UV treated CA film | ChNF | Stainless Steel | Aluminum | Acrylic |
|---|---|---|---|---|---|---|
| 0.5 wt % ChNF | 56.3° | 37.4° | | 72.6° | 79.7° | 69.9° |
| 0.5 wt % CNC | 64.6° | 62.2° | | 69.6° | 87.2° | 75.5° |
| 8 wt % CNC | 70.2° | 66.8° | 69.8° | — | — | — |

In dual layer slot die coating, surface tension (w) plays a critical role in controlling the stability of the bilayers. The surface tension of the bottom layer coating (wb) can be higher than the that of the top layer (wt), in order for the top layer to spread uniformly across the bottom layer. The surface tensions of 0.5 wt % ChNF, 5, 7, and 8 wt % CNC are given in Table 2. The surface tension of 0.5 wt % ChNF is higher than that of 8 wt % CNC, which is desireable, to ensure stable thinning and edge effects.

TABLE 2

Surface tension measurement of ChNF and CNC suspensions

| 0.5 wt % ChNF | 5 wt % CNC | 7 wt % CNC | 8 wt % CNC |
|---|---|---|---|
| 63.3 ± 0.3 mN/m | 71.4 ± 0.2 mN/m | 67.3 ± 0.9 mN/m | 56.1 ± 3.2 mN/m |

Another important material property is viscosity. A conventional study observed that dewetting can occur if the top layer becomes too thin due to having too low a viscosity. Here, the viscosities of the CNC suspensions were substantially different in order to accommodate requirements of the two coating techniques, namely spray coating and slot die coating. The CNC suspension concentration for spray coating was 0.5 wt % whereas that for the slot die coating process was up to 8 wt % to produce stable coatings. The viscosity measurements for 0.5 wt % CNC and 8 wt % CNC in addition to 0.5 wt % ChNF is found in FIG. 2. The 0.5 wt % ChNF and 0.5 wt % behaved as Newtonian fluids at a shear rate greater than 25 $s^{-1}$ and 63 $s^{-1}$, respectively, which indicated negligible interfiber interactions at these dilute conditions. The 8 wt % CNC was non-Newtonian with shear thinning behavior at a shear rate ranging from 0.1 $s^{-1}$ to 1000 $s^{-1}$ and had a higher viscosity than 0.5 wt % CNC over this range. The shear thinning behavior, which indicated the CNCs were in a chiral nematic phase, can be described by the power law.

$$\gamma = \frac{u_w}{H}$$

where, $u_w$ is substrate speed and H is the coating gap.

As previously mentioned, CNC and ChNF suspensions dewetted on the untreated CA film, which is illustrated in FIGS. 3B-C for blade coated thin film. Based on the UV treatment results, single layers of 0.5 wt % CNC, 0.5 wt % ChNF, and 8 wt % CNC suspensions were separately blade coated on CA film that had been treated for 5 min at 70° C. as shown in FIGS. 3D-F. FIGS. 3E-F demonstrate that 0.5 wt % ChNF and 8 wt % CNC wet the CA surface well under these conditions.

To check the wetting behavior, 5 mL of 5 wt % to 8 wt % concentrations of CNC suspensions were blade coated onto untreated and UV treated CA, as a qualitative assessment. It was found that increasing the concentration of CNC to 8 wt % produced good wetting on UV treated CA film as demonstrated in FIG. 3F.

Developing a coating window for dual layer slot coating can be challenging due to the various failure mechanisms possible at the two interfaces (CA-ChNF and ChNF-CNC), which may not be easily observed. Here, a first approximation approach was taken by creating a partial coating window of the bottom layer, 0.5 wt % ChNF, on the CA substrate. It was assumed that the substrate speed during dual layer slot die coating would be limited by defects formed between the ChNF and the CA film, due to a pressure driven coating instability, as observed at the air entrainment boundary, while the quality of the CNC film would be more greatly limited by the surface tension. Furthermore, it has been shown by a pair of conventional studies that the quality of the interlayer is dependent upon the stability of the separation point, which is a function of the material properties and processing conditions.

Leveraging the strong correlation between the flow rate and substrate speed of a single coating solution during the continuous slot die coating process on a R2R system, as shown in FIG. 4A a trial process window for the 0.5% ChNF suspension coated on UV treated CA film was obtained. For these experiments, 6" by 4" samples of CA films were UV treated at 70° C. for 5 minutes, the flow rate was set to 0.05 to 70 ml/min, and the substrate speed ranged from 5 to 21 mm/s (limited in part due to the size of the substrates as well as inherent noise in the coating system). As one parameter was increased while the other remained constant, the air entrainment or dripping phenomena were obtained to form the partial coating window, as shown in FIG. 4B. FIGS. 4C-D capture the air entrainment and dripping instabilities visually. Using this data, the substrate speed and flow rate for defect-free 0.5 wt % ChNF wet film of a known thickness can be obtained.

For the bilayer slot die coating process, shown in FIG. 5A, the CNC is coated onto ChNF, which is coated onto a UV treated film. Guided by the coating window, the substrate speed was set to 5 mm/s, the lower limit of the casting speed (uw) within the coating window of ChNF. This value was selected because the lower limit for the CNC suspension is not known, due in part to the lack of substrate material, i.e., 0.5 wt % ChNF dry film. The coating gap and UV treatment condition were 200 μm and 70° C. for 5 min, respectively. The flow rate of ChNF was set to 6 ml/min, which is within the for the boundary of the chosen substrate speed.

Initially, 7 wt % CNC was used for as the top layer solution. However, during the coating process, the 0.5 wt % ChNF and 7 wt % CNC mixed and dewetted the substrate. This was due to the surface tension of the 7 wt % being higher than of the 0.5 wt % ChNF. The concentration of CNC was increased to 8 wt %, which was found to wet the 0.5 wt % ChNF liquid well. However, at this viscosity, the solution can take on a gel-like nature. In consideration of this gel-like nature and to prevent the two coating suspensions from mixing during the bilayer coating process, the flow rate of 8 wt % CNC was tuned. Mixing can be caused by a phenomenon known as mid-gap invasion, due to vortices and fluctuations at the separation line. For this set of processing parameters, the flow rate was varied from 20-30 ml/min. When ChNF and CNC mixes, an opaque film at the interface forms due to micro vortices, which can be visible by direct observation. The defects resulting from mid-gap invasion were readily observed with changing processing conditions, in this case flow rate. By observation, mixing due to mid-gap invasion occurred when the flow rate of CNC decreased below 20 ml/min and for CNC suspensions below 8 wt %. It is important to note that prior conventional studies found that mid-gap invasion was dominated by the flow rate of the bottom layer, for water and glycerin bilayers, which is counter to the observations made here. However, the mixing could be due to having a higher viscosity ratio (i.e., the viscosity of the top layer is higher than that of the bottom layer) leading to mixing along the lip of the middle die plate. At flow rates above 30 ml/min another defect that was observed was weeping, a condition when the liquid collects upstream of the slot die (i.e., opposite the direction of flow).

By balancing the viscosity, surface tension and flow rate, it was shown that stable bilayer film can be fabricated. However, it was imperative that CA film be UV treated for 5 minutes at temperatures between 40-70° C. to establish good wetting. It was found that high quality wet bilayer film could be formed under these conditions, as shown in FIGS. 5B-D. As given in Table 2, the surface tension of 0.5 wt % ChNF is higher than that of 8 wt % CNC. This enabled uniform spreading of the 8 wt % CNC across the 0.5 wt % ChNF. This desired condition, may be further explained by the electrostatic interaction between CNC and ChNF, which would further reduce the surface tension between the suspensions. This electrostatic behavior has been observed in a previous study and is promoting the fabrication of the multilayer films containing alternating ChNF and CNC layers. A conventional study investigated dual layer slot coating of relatively high viscosity liquids. They found that up to a critical point, high wet thickness ratio (top coating is thicker than the bottom coating), the coating would be stable due to the pressure gradient. Here, the thickness of the 8 wt % CNC coating layer is higher than that of the 0.5 wt % ChNF layer and the results align with observations made by Schmitt et al. who showed that thicker films are necessary when the viscosity of the top layer is high.

Based on the results above, defect-free bilayers were continuously fabricated using the collection of optimal parameters that constrains the processing conditions for slot die coating the ChNF/CNC bilayer film on a UV treated CA film. To mitigate deformation due to UV treatment, CA film were treated at 40° C. for 5 min. The coating gap was 200 μm and substrate speed was set to 5 mm/s. The flow rate of the 0.5 wt % ChNF and 8 wt % CNC were set to 6 ml/min and 20 ml/min, respectively. Under these conditions, high quality, uniform wet bilayer thin films were formed, using dual layer slot die coating. However, a major challenge was observed when drying the film.

The drying process can be a major factor for any continuous R2R process. Details of the drying process often go unreported; however, this critical step can encounter a variety of issues. For instance, the coating liquids and the substrates often have different working and/or drying temperatures. Though not always feasible, rapid drying is often desired during manufacturing. Slower drying methods such as air drying in ambient conditions, hot drying in an oven or infrared drying at temperatures ranging from 100° C. to 120° C. on paper substrates and freeze drying have been used when fabricating relatively high viscosity CNC suspensions. These CNC suspensions, which were also highly crystalline, have been shown to exhibit various challenges that resulted in inadequate adhesion to various substrates and created relatively thick coating layers that are more difficult to dry. This may point to a necessary trade-off in the current study, as the higher viscosity of the CNC can be necessary for stable dual layer slot die coatings, which can lead to thicker CNC layers, in contrast to the much thinner film producible via spray coating. Air drying in ambient conditions and a vacuum oven (with or without desiccant in both cases) can be used to dry the coating film. Furthermore, it is well known that cellulose, the main constituent in CNC, absorbs moisture in the air, which can make it more difficult to dry. When spray coating very thin layers, on a hot platen at 65° C. the CNC can quickly dry and is thus may not be limited by the ambient conditions. Conversely, the high humidity (greater the 50%) exhibited from late spring through early fall, can present a unique challenge for the dual layer slot coating process. To account for this as much as possible, desiccant can be added to the chambers where the samples were air dried or oven dried.

For illustrative purposes, sample pictures of 0.5 wt % ChNF and 8 wt % CNC bilayers dried in air and in an oven (with and without desiccant are provided in FIGS. 6A-E.

Air drying in humid and dry conditions was found to minimize post processing defects such as substrate buckling and deformation, pooling and chemical reactions. However, cracks could be formed when the humidity in the air was high, as illustrated by comparing FIGS. 6A and E. However, air drying was extremely slow taking up to 24 hours. This condition is not scalable, so alternative methods for drying must be considered. Typical roll-to-roll systems can have zoned heating to uniformly and quickly dry wet film. To mimic this, oven heating can be conducted.

Drying analysis was conducted under various temperatures ranging from 60-100° C. in a preheated oven for 15-60 min and under ambient (humid) or dry (desiccant) conditions. When the drying temperature exceeded 80° C. in humid air (50% RH or higher), the UV treated CA film exhibited deformation and buckling, presumably due to differences in swelling and stress relaxation in the CA film versus the bilayer of ChNF and CNC. In addition, the maximum working temperature of the UV treated CA film was 55-95° C., based on the manufacturer's specifications. Various areas of the bilayer film retained moisture or pooling, especially in the center of the sample at lower drying temperatures and longer drying times, such as at 60° C. for 60 minutes, as exhibited in FIG. 6B. High water content in the suspensions produced vapor that evaporated at different rates causing stress concentrations in the film leading to bucking of the films. This is plausible given that the UV treated CA film had low water permeability and high moisture vapor transmission. Although the working temperature of the UV treated CA film was limited, efforts to dry the film more uniformly and to decrease the drying time led to increasing the drying temperature. When the bilayer was dried at 100° C. for 30 minutes in humid conditions, a (yellow/brown) color developed in the film, suggesting a chemical reaction in the coating bilayer, as shown in FIG. 6D. This may be due to the oxidation of hydroxyl groups in cellulose to keto groups and carboxylic acids. To minimize chemical changes during drying, as well as reduce the time available to swell the CA substrate, the bilayer was dried at 80° C. at 30% RH for 15 minutes. It can be observed that no moisture build-up within the bilayer occurred, and the film became more uniform, as seen in FIG. 6E, as the RH decreased below 25% RH. However, some buckling could still be observed at RH values above 25%.

The best results for dried films occurred either when (i) the water was removed quickly and as assisted by heating and desiccant, or (ii) slowly in dry air after coating. When the coated samples were placed in the pre-heated oven lacking ventilation, interior of the oven became extremely humid, leading to much longer drying times to completely dry the film and deformation. The presence of desiccant inside the oven drastically reduced the time needed for drying the coated samples and resulted in less deformed films. The best drying condition was found to be 80° C. for 15 minutes with desiccant.

Figure 7A:
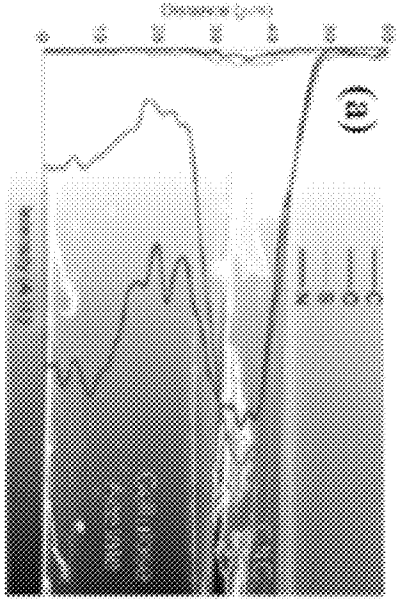
Figure 7C:
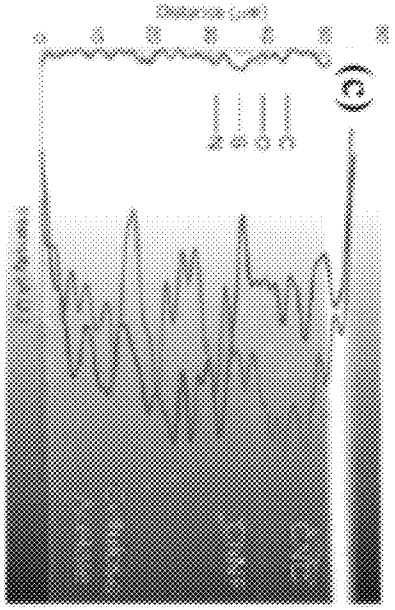
Figure 7B:
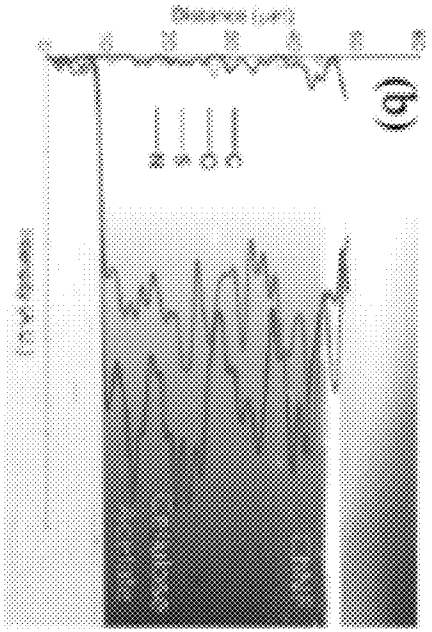
Figure 8:
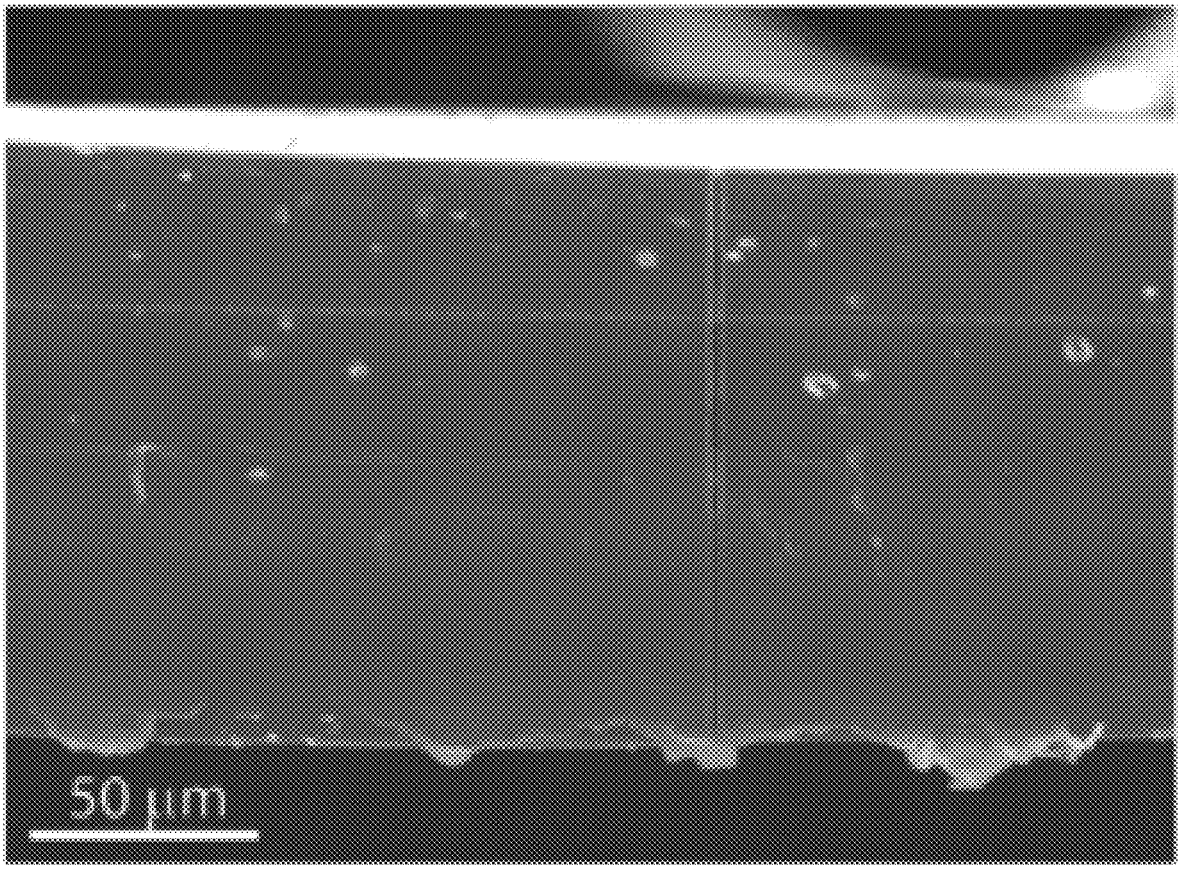
FIG. 8 illustrates an SEM micrograph of the region from which an EDS line scan was collected. A transition between the cellulose acetate layer (shown at the bottom of the image) and the ChNF layer is visualized by a change in the width of the burn resulting from the line scan in accordance with an exemplary embodiment of the present invention.

The structure and composition of the multilayer films were characterized by SEM and EDS. These results are presented in FIG. 7. The samples were cut and the cross-section of each film was analyzed. Some delineation between texture and contrast of the various layers are evident in the SEM micrographs. The EDS line scans provide compositional data to complement the images and assist in identifying the material in each layer. The sample consisting of CNC on CA exhibited poor interfacial adhesion, as evidenced by severe delamination of the layers in some regions. The transition between the CA and CNC layers is clearly observable in FIG. 7A. This is likely due to the negative charges that are present on the sulfate groups of the CNCs and the acetate groups on the cellulose acetate. In contrast, virtually no delamination was observed between ChNF and CA, as shown in FIG. 7B, however a slight change in texture and contrast delineates the transition between layers. The tri-layer film, wherein the ChNF is in direct contact with the underlying CA and the CNC layer above, as shown in FIG. 7C, also displayed intimate contact between the layers and was devoid of delamination. These results implicate the function of the positively charged ChNF as an adhesion layer between the negatively charged cellulose acetate and CNC materials.

Figure 12:
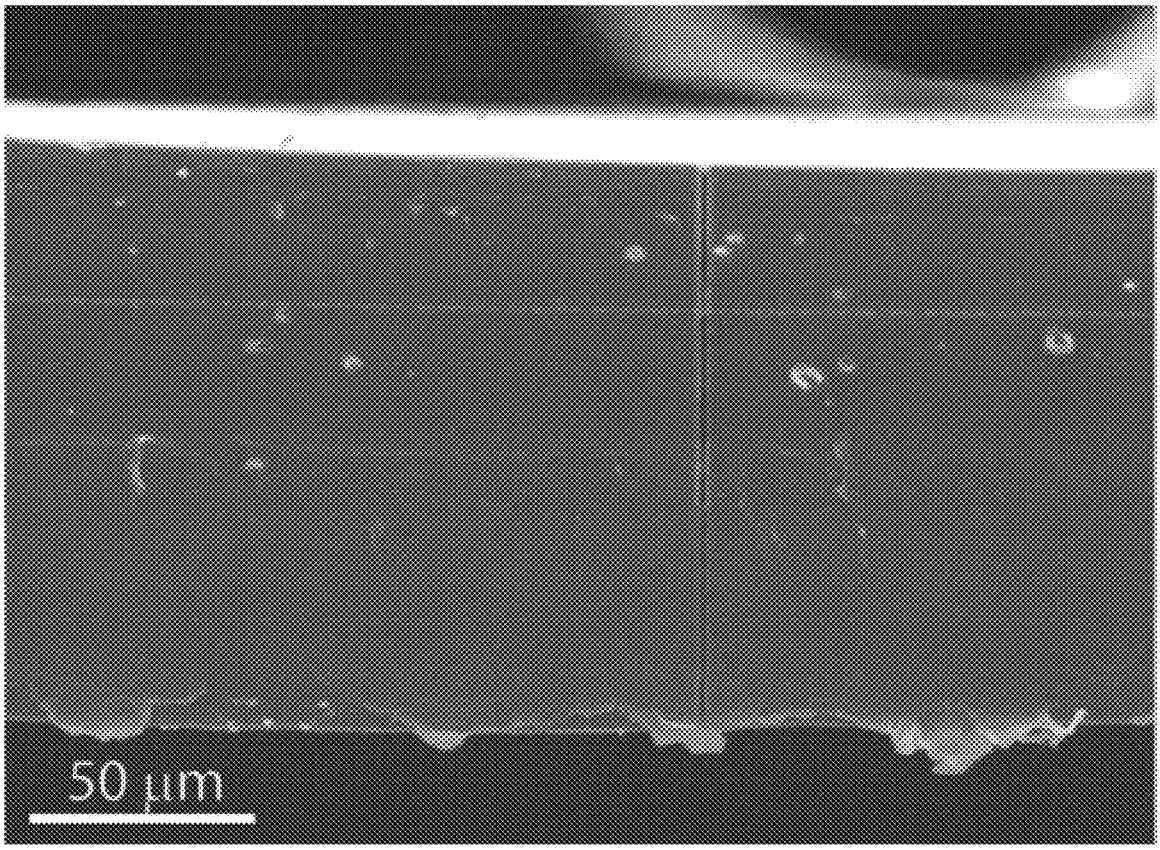
FIG. 12 illustrates a SEM micrograph of the region from which an EDS line scan was collected, in accordance with an exemplary embodiment of the present invention. A transition between the cellulose acetate layer (shown at the bottom of the image) and the ChNF layer is visualized by a change in the width of the burn resulting from the line scan.

The propensity of carbohydrate materials to burn under the electron beam complicated EDS data collection and precluded long dwell times, which in turn resulted in a relatively low signal to noise ratio. However, some useful trends were still observable. These data are shown as overlays on the SEM micrographs in FIG. 7. In all the samples analyzed, the cellulose acetate layer exhibited a higher carbon-to-oxygen ratio than both the CNC and ChNF layers. In the case of the tri-layer film, the transition from high to low C:O ratio provides a more obvious indication of the transition between the cellulose acetate and ChNF layers than can be observed from the SEM micrograph. Nevertheless, some slight increases in the EDS signal intensity for these elements can be observed within the material layers for which they are associated. Additional evidence of the multilayer structure of the film can be observed by imaging the area where each line scan was performed subsequent to data collection, as shown in FIG. 12, where the burned region is noticeably thinner across the cellulose acetate than it is across the ChNF and CNC layers.

As shown in FIGS. 9A-F, the air-dried film had better adhesion compared to the oven-dried film, where the coating delaminated less than 5% (1B) and more than 50% (4B). As for the spray-coated film, the adhesion was very poor; the whole film delaminated (0B) as shown in FIGS. 9G-I. It has been shown experimentally that thicker coatings improve adhesion testing results. Hence, the poor adhesion exhibited by the spray-coated samples is attributed to the film thickness (which is on the order of 1-5 μm) and preexisting deformation of the overall coating. Moreover, the slot die-coated CA film was UV-treated, which is believed to enhance bonding between the fluid and the substrate material as it was drying. For the oven-dried dual layer slot die-coated film, there was some deformation (buckling) of the film during drying, which led to lower adhesion. As previously mentioned, the working temperature for the substrate is between 55 and 95° C. The spray-coated film displayed some uneven surface structures that may result from the droplet distribution.

The dual layer coating of ChNF/CNC functioned as an excellent oxygen barrier on the CA substrate. The oxygen permeabilities of selected films prepared by either spray coating or slot die coating are listed in Table 4, together with their thicknesses and the information for neat CA substrates. The selected coated samples were either dried under ambient conditions or in a vacuum oven with desiccant at 80° C. for 15 min. For the slot die coated films with a single ChNF or CNC layer or a dual ChNF/CNC layer, the OP decreased significantly comparing to the OP of the neat UV-ozone-treated CA film. The difference in OP of the air-dried or oven-dried CA-ChNF films is mainly derived from the coating thickness (i.e., the difference in thickness between the coated and uncoated CA film); the air-dried CA-ChNF had a coating thickness that was twice of that of the oven-dried film, and its OP was halved. The CA-ChNF/CNC bilayer film had an OP of only 1.22±0.06 $cm^3$ $\mu m/m^2/day/kPa$, which is 99.8% lower than that of the uncoated CA film. This OP is also lower than that of a spray-coated PLA-ChNF-CNC film in the previous study (~20 $cm^3$ $\mu m/m^2/day/kPa$), which is probably because of the much thicker coating layer. The result is considerably lower than the OP of commercial PET film (10-50 $cm^3$ $\mu m/m^2/day/kPa$), which is widely utilized as an oxygen barrier in food packaging applications. Its calculated OTR in room atmosphere (i.e., 21 kPa of $O_2$ driving force) was 0.24±0.01 $cm^3$ $\mu m/m^2/day/kPa$, which is in the range of OTR requirement for instant coffee packaging (i.e., 0.2-2 $cm^3/m^2/day$).

The OP values of the CA-CNC films were not measurable because their OTR values were lower than the lower testing limit, which is 1 $cm^3/m^2/day$. The lack of a ChNF layer, which functions as not only an oxygen barrier but also an adhesive between CA and CNC, led to a poor wettability of the coating on CA, as shown by the contact angle measurements. Thus, the CNC coating shrank on the CA film and resulted in a substantially thicker CNC layer comparing to that of the CA-ChNF/CNC film. In addition, because of the alignment of ChNF and CNC chains, due to the shear forces during slot die coating, and the OP of the CNC coating has been reported to significantly decrease with an increasing degree of alignment, the thicker CA-CNC film had a lower OP than the relatively thinner CA-ChNF/CNC film.

As a comparison, the CA-ChNF/CNC films prepared by lab-scale spray coating had an OP which was 97% lower than that of the neat CA film. The slot-die-coated CA-CNC and CA-ChNF/CNC samples exhibited better oxygen barrier properties than the spray-coated films, which was mainly caused by the much thicker coating layer and the higher degree of alignment. The difference in OP between the slot-die-coated and spray-coated CA-ChNF films could also be the result of the variation in coating thickness. Second, the compositions of the coatings were different. The applied mass ratios of ChNF to CNC for the slot die-coated and the spray-coated films were ~1:50 and ~1:1, respectively. They were calculated based on the flow rates for slot die coating, the volumes of the suspensions for spray coating, and the solid contents of the suspensions. Finally, it is possible that the ChNFs and CNCs aligned due to the shear forces during slot die coating. It has been reported that the OP of CNC significantly decreases with an increasing degree of alignment. As is shown in the AFM images in FIG. 10, the oven-dried slot die-coated film showed a higher degree of alignment on the surface qualitatively, while no significant alignment was observed on the surfaces of the spray-coated film and the air-dried slot die-coated film. The degree of alignment was not as high as those observed by a conventional study mainly because the alignment increased with an increasing shear rate (0-700 $s^{-1}$), but the shear rate in our work was only 25 $s^{-1}$ with a coating speed of 5 mm/s and a coating gap of 200 μm.

Figure 10A:
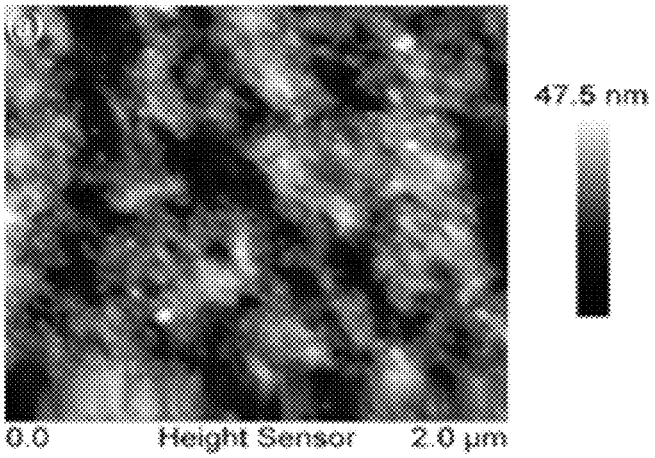
FIGS. 10A-C illustrates AFM images of various films, in accordance with an exemplary embodiment of the present invention.
Figure 10B:
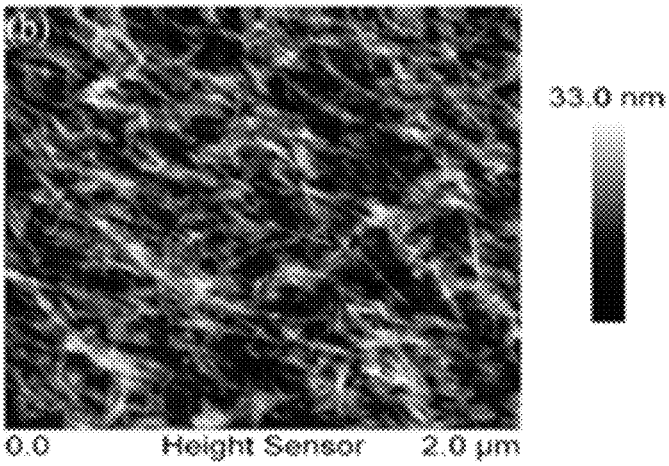
Figure 10C:
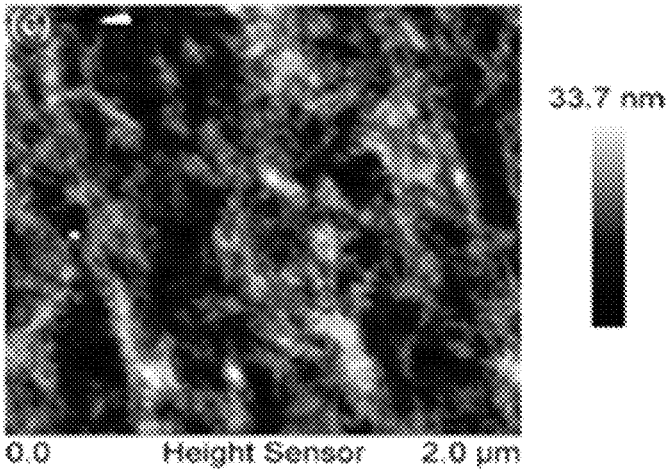

To provide insight about ChNF's dual role as a wetting and adhesion promoter and its role in enhancing barrier properties, an additional experiment was performed by replacing ChNF with a common cationic primer, poly(ethyleneimine) (PEI). The resulting films are shown in FIG. 10. Comparing the OP values of CA-ChNF-CNC films with CA-PEI-CNC films in Table 3 shows that the ChNF-CNC coatings had higher, between 7 and 20 times better, OP performance (lower OP value) than the PEI-CNC coatings, depending on the drying method and coating preparation conditions. This proves that the ChNF layer functions as an adhesion promoter (from adhesion experiments in FIGS. 9A-I) and contributes significantly to the barrier properties.

TABLE 3

Coating thickness and OP value comparison of different films

| Film type | Drying Method | Coating Thickness (μm) | OP ($cm^3\mu m/m^2/day/kPa$) | Calculated OP for coating ($cm^3\mu m/m^2/day/kPa$) |
|---|---|---|---|---|
| CA-PEI-8 | Oven-dried | 16 ± 1 | 53.9 ± 0.9 | 10.4 |
| wt % CNC | Air-dried | 12 ± 2 | 22.8 ± 0.4 | 3.3 |
| CA-ChNF-7 | Oven-dried | 8 ± 2 | 15.4 ± 0.4 | 1.5 |
| wt % CNC | | | | |
| CA-ChNF-8 | Oven-dried | 31 ± 6 | 1.50 ± 0.3 | 0.51 |
| wt % CNC | Air-dried | 39 ± 2 | 1.22 ± 0.006 | 0.36 |

Figure 11:
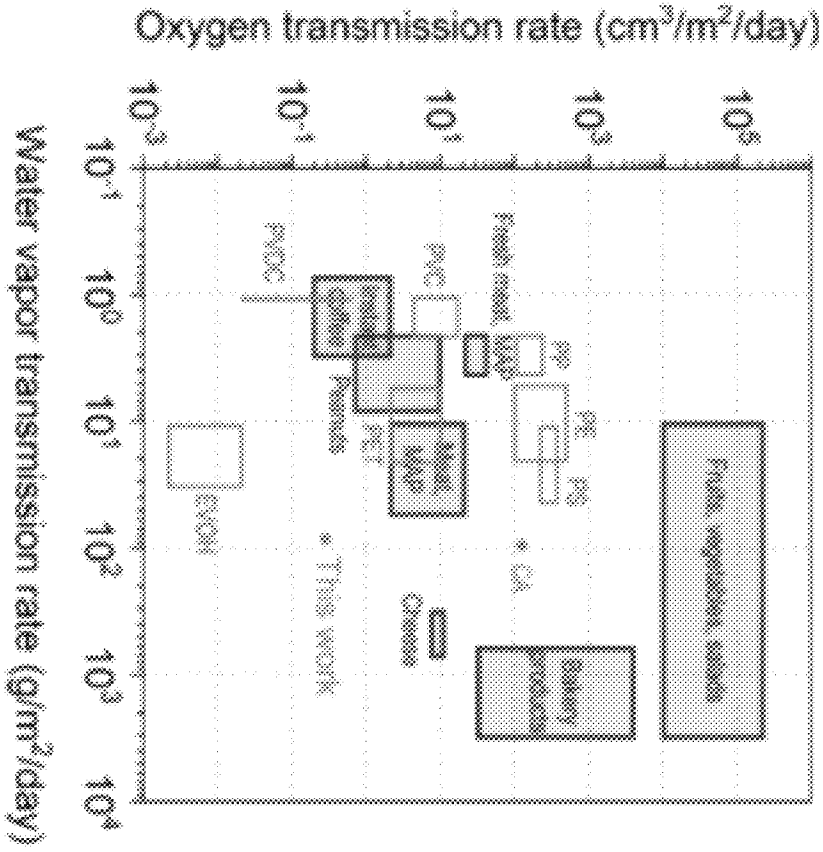
FIG. 11 illustrates oxygen and water vapor transmission rate requirements for food products (shaded) and properties for common plastics for packaging (outlined) as a compared to biodegradable barrier films, in accordance with an exemplary embodiment of the present invention. AP: modified atmosphere packaging; PET: poly(ethylene terephthalate); PP: polypropylene; PE: polyethylene; PS: polystyrene; PVC: poly(vinyl chloride); EVOH: ethylene vinyl alcohol; and PVDC: poly(vinylidene chloride). The OTR value for EVOH was obtained at 23° C. and 0% RH, and those for other plastic materials were measured at 23° C. and 50% RH for all plastic materials. The WVTR values were obtained at 23° C. and 85% RH for all plastics except CA, which was tested at 23° C. and 50% RH in this work. Data are normalized for 100-μm-thick films at room temperature (with 21 kPa 02 driving force).

The OP values for a dual-layer slot die-coated film in this work were considerably lower than those of many common gas barrier materials for packaging application, including the PET film (10-50 $cm^3$ μm/$m^2$/day/kPa), as depicted in FIG. 11. The thickness-normalized water vapor transmission rate (nWVTR) was also measured for the air-dried dual-layer sample, which was 7.8±0.2 g mm/$m^2$/day and was 37% lower than that of a neat CA film (i.e., 12.4±0.22 g mm/$m^2$/day). The corresponding nonnormalized OTR and WVTR values at a thickness of 100 μm and 21 kPa of $O_2$ driving force at room temperature were 0.32±0.01 cm/$m^2$/day and 78±2 g/$m^2$/day. These properties suggest that the product in this work meets the requirements of OTR and WVTR for cheese, bakery products, and fresh food packaging. The OTR could also satisfy the requirements for instant office, MAP, meat, and peanut packaging, but further improvement in the water vapor barrier property is necessary. This is mainly because of the hydrophilicity of the biobased materials in this work. One possible method is to apply another thin layer on the top of the CA-ChNF/CNC films as a moisture barrier, such as PVDC or PP, to meet the WVTR requirement for food packaging.

TABLE 4

Comparison of the thicknesses and oxygen permeabilities (OP) of neat substrates and selected coated films with different post drying conditions prepared by spray coating and slot die coating.

| Coating method | Materials | Post drying conditions[b] | Thickness (μm) | Coating Thickness (μm) | Oxygen permeability ($cm^3$ pm($m^2$/day/kPa) |
|---|---|---|---|---|---|
| Slot die coating | CA | N/A | 75 ± 0 | 0 | 521 ± 3 |
| | CA-ChNF | Air-dried | 79 ± 2 | 4 ± 2 | 62.2 ± 1.5 |
| | CA-ChNF | Oven-dried | 77 ± 0 | 2 ± 0 | 125 ± 1 |
| | CA-CNC | Air-dried | 112 ± 8 | 37 ± 8 | N/A[c] |
| | CA-CNC | Oven-dried | 118 ± 5 | 43 ± 5 | N/A[c] |
| | CA-ChNF/CNC | Air-dried | 114 ± 2 | 39 ± 2 | 1.50 ± 0.30 |
| | CA-ChNF/CNC | Oven-dried | 106 ± 6 | 31 ± 6 | 1.22 ± 0.06 |
| Spray coating[a] | CA | N/A | 76 ± 1 | 0 | 757 ± 18 |
| | CA-ChNF | | 80 ± 1 | 4 ± 1 | 51.7 ± 0.8 |
| | CA-CNC | | 79 ± 1 | 3 ± 1 | 103 ± 2 |
| | CA-ChNF/CNC | | 80 ± 1 | 4 ± 1 | 23.2 ± 0.2 |

[a]The CA films utilized for spray coating were not treated with UV-ozone, so the neat substrate had a different thickness and oxygen permeability compared to the one for slot die coating. The drying in oven was conducted with a desiccant at 80° C. for 15 min.

This study demonstrated the viability of fabricating bilayer film composed of chitin and cellulose nanocrystal to tune barrier materials by employing the dual layer slot die coating method mounted on a continuous R2R system. In this work, the scalability of ChNF/CNC bilayer film were explored. To this end, optimal conditions to simultaneously coat the ChNF and CNC solutions were obtained for solution concentrations of 0.5 wt % and 8 wt % respectively. To coat quality bilayer film, it was found that the CA film had to be UV treated for 5 min at 70° C. and the coated film dried at 80° C. for 15 mins in low relative humidity. Controlling relative humidity during the drying process was found to be crucial in shortening the length of the drying process and to produce the films with less deformation.

The cross-sectional analysis of the coated samples through SEM and EDS analysis confirmed that the fabricated films contained both layers with controlled thickness. Comparing spray coated and dual layer slot die coated ChNF/CNC barrier films, it was found that the dual layer slot die exhibited significantly lower OP by 20 times. A similar trend was observed for the single layer films and commercially available PET. It is believed that the decrease in OP was enhanced due to the alignment of ChNF and CNC chains during the dual layer slot die coating process in addition to the electrostatic interaction of CNC and ChNF. This study demonstrates a scalable process to fabricate highly functional ChNF/CNC bilayer films and opens a pathway to fabricating low OP barrier film.

Certain embodiments and implementations of the disclosed technology are described above with reference to block and flow diagrams of systems and methods and/or computer program products according to example embodiments or implementations of the disclosed technology. It will be understood that one or more blocks of the block diagrams and flow diagrams, and combinations of blocks in the block diagrams and flow diagrams, respectively, can be implemented by computer-executable program instructions. Likewise, some blocks of the block diagrams and flow diagrams may not necessarily need to be performed in the order presented, may be repeated, or may not necessarily need to be performed at all, according to some embodiments or implementations of the disclosed technology.

While the present disclosure has been described in connection with a plurality of exemplary aspects, as illustrated in the various figures and discussed above, it is understood that other similar aspects can be used, or modifications and additions can be made to the described aspects for performing the same function of the present disclosure without deviating therefrom. For example, in various aspects of the disclosure, methods and compositions were described according to aspects of the presently disclosed subject matter. However, other equivalent methods or composition to these described aspects are also contemplated by the teachings herein. Therefore, the present disclosure should not be limited to any single aspect, but rather construed in breadth and scope in accordance with the appended claims.

What is claimed is:

1. A method comprising:

coating a supporting base layer with a dual layer oxygen barrier film comprising a chitin material and a cellulosic material to form a membrane;

wherein:

the coating comprises a roll-to-roll coating process; and the membrane has an oxygen permeability less than 20 $cm^3$ $\mu m/m^2/day/kPa$ at 23° C. and 50% relative humidity.

2. The method of claim 1, wherein the membrane has an oxygen permeability of less than 10 $cm^3$ $\mu m/m^2/day/kPa$ at 23° C. and 50% relative humidity.

3. The method of claim 1, wherein the membrane has an oxygen permeability ranging from about 1 $cm^3$ $\mu m/m^2/day/kPa$ to about 9 $cm^3$ $\mu m/m^2/day/kPa$ at 23° C. and 50% relative humidity.

4. The method of claim 1, wherein the membrane has a thickness of about 106 μm and an oxygen transmission rate ("OTR") in room atmosphere of about 0.24 $cm^3/m^2/day$.

5. The method of claim 1, wherein the supporting base layer comprises cellulose acetate ("CA").

6. The method of claim 1, wherein the roll-to-roll coating process comprises:

flowing the dual layer oxygen barrier film through a dual slot die; and depositing the dual layer oxygen barrier film over the supporting base layer.

7. The method of claim 6, wherein flowing the dual layer oxygen barrier film through the dual slot die comprises:

flowing a first fluid comprising chitin nanofibers ("ChNF") through a first slot in the dual slot die at a flow rate of between 2-6 ml/min; and flowing a second fluid comprising cellulose nanocrystals ("CNC") through a second slot in the dual slot die at a flow rate of between 20-30 ml/min.

8. The method of claim 7, wherein:

the first fluid is disposed over the supporting base layer; and the second fluid is disposed over the first fluid.

9. The method of claim 8, wherein the first fluid comprises a solution of at least 0.5 wt % ChNF.

10. The method of claim 8, wherein the second fluid comprises a solution of at least 5 wt % CNC.

11. The method of claim 1 further comprising:

performing an ultraviolet treatment to the supporting base layer for at least 5 minutes prior to the coating.

12. The method of claim 11, wherein the ultraviolet treatment occurs at a temperature between about 40° C. to about 70° C.

13. The method of claim 1 further comprising:

subjecting the membrane to a drying process.

14. The method of claim 13, wherein the drying process comprises exposing the membrane to a vacuum oven preheated to a temperature range of from about 60° C. to about 100° C.

* * * * *